United States Patent [19]

Willis

[11] 4,314,611

[45] Feb. 9, 1982

[54] APPARATUS FOR SUPPORTING AND ROTATING A DOWN HOLE TUBULAR

[75] Inventor: Clyde A. Willis, Wichita Falls, Tex.

[73] Assignee: Walker-Neer Manufacturing Co., Inc., Wichita Falls, Tex.

[21] Appl. No.: 158,452

[22] Filed: Jun. 11, 1980

[51] Int. Cl.[3] ..... E21B 3/00; E21C 7/10

[52] U.S. Cl. ..... 173/57; 173/163; 173/DIG. 3

[58] Field of Search ..... 173/57, 163, DIG. 3; 175/85, 122 (U.S. only)

[56] References Cited

U.S. PATENT DOCUMENTS

| | | | |
|---|---|---|---|
| 1,398,551 | 11/1921 | Hanson | 173/57 X |
| 2,334,312 | 11/1943 | Caldwell | 173/57 X |
| 2,964,115 | 12/1960 | Clatfelter | 173/163 X |
| 2,998,084 | 8/1961 | Johnson et al. | 175/85 |
| 3,736,993 | 6/1973 | West | 173/163 |
| 3,741,318 | 6/1973 | Klein et al. | 173/57 X |
| 3,776,320 | 12/1973 | Brown | 173/163 |

FOREIGN PATENT DOCUMENTS

| | | | |
|---|---|---|---|
| 1224681 | 9/1966 | Fed. Rep. of Germany | 173/163 |
| 2033844 | 11/1971 | Fed. Rep. of Germany | 173/57 |
| 1487466 | 5/1967 | France | 173/163 |

*Primary Examiner*—Wm. Carter Reynolds
*Attorney, Agent, or Firm*—Hume, Clement, Brinks, Willian & Olds, Ltd.

[57] ABSTRACT

A top head drive unit for an earth boring apparatus including a derrick comprises a support member guided along the derrick. The support member includes a pair of spherical roller bearings which support a shaft adapted for connection to a drill string. These roller bearings accommodate a selected degree of movement in the axis of rotation of the shaft. The shaft extends up above the support member, and a rotary drive unit is mounted to the shaft immediately above the support member. Precision roller bearings are used to align the drive unit precisely on the shaft such that the drive unit follows the movement of the shaft as it rotates in the spherical roller bearings of the support member and a torque arm is mounted between the support member and the rotary drive unit to prevent rotation of the rotary drive unit with respect to the support member. A drilling fluid seal is rigidly mounted to the upper surface of the drive unit to follow the movement of the shaft precisely and thereby to provide a fluid tight seal through which drilling fluids can be passed into the shaft.

23 Claims, 9 Drawing Figures

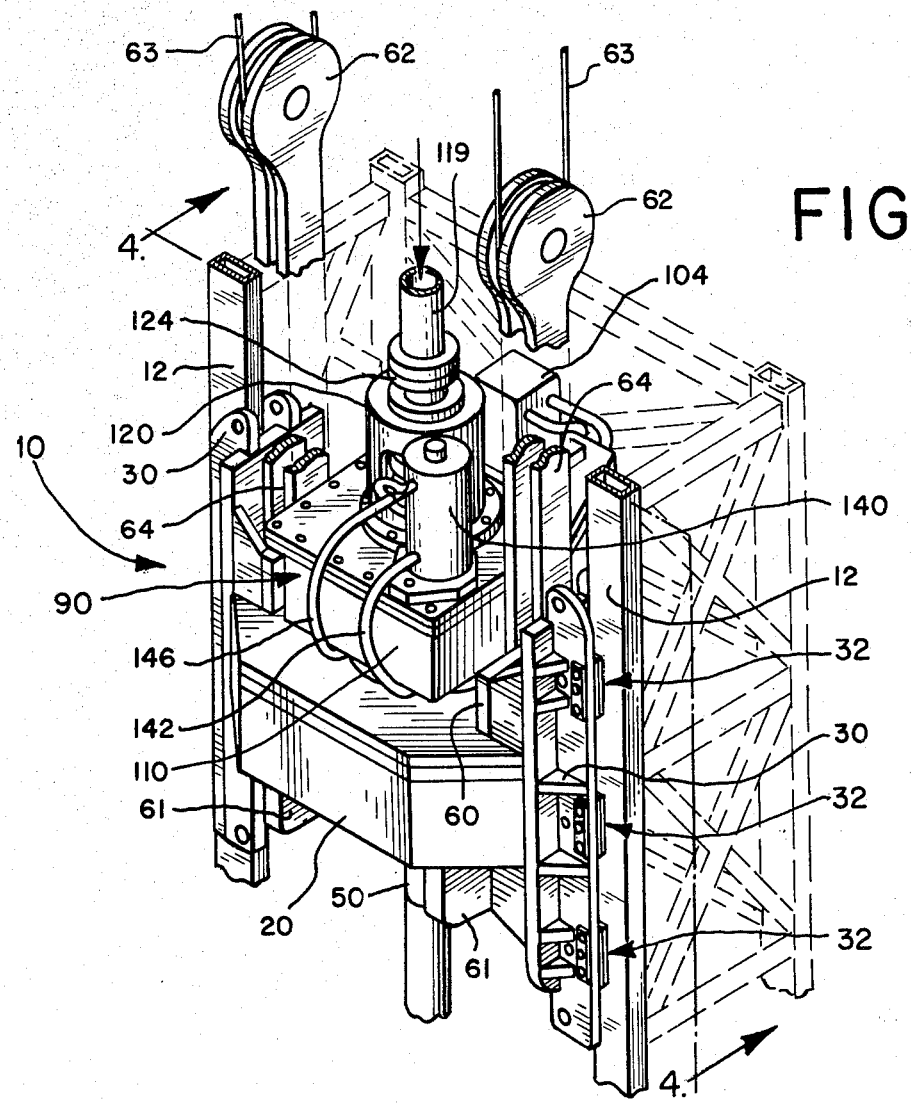
FIG. 1
FIG. 2
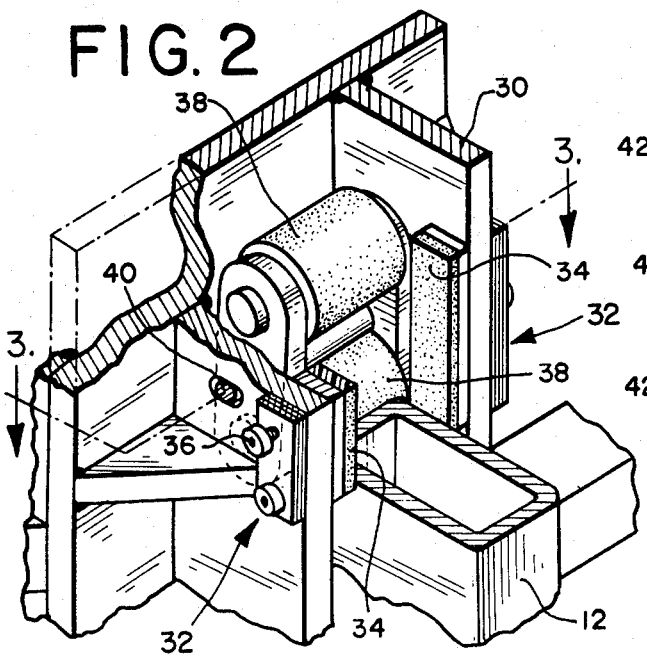
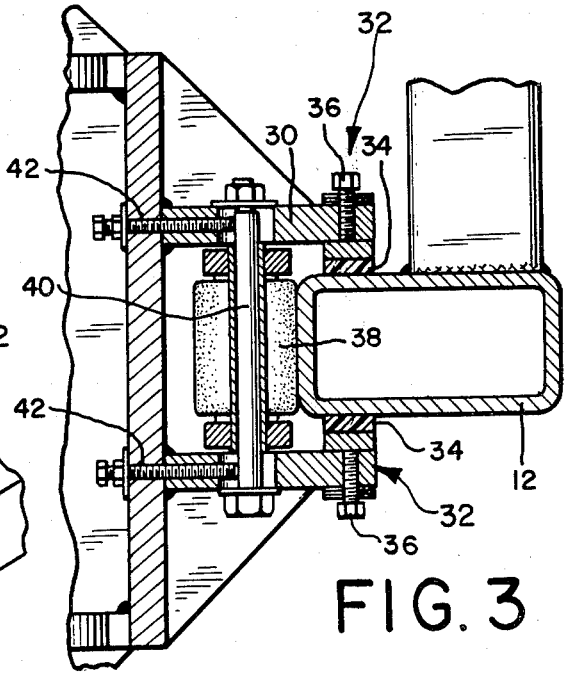
FIG. 3

FIG. 4
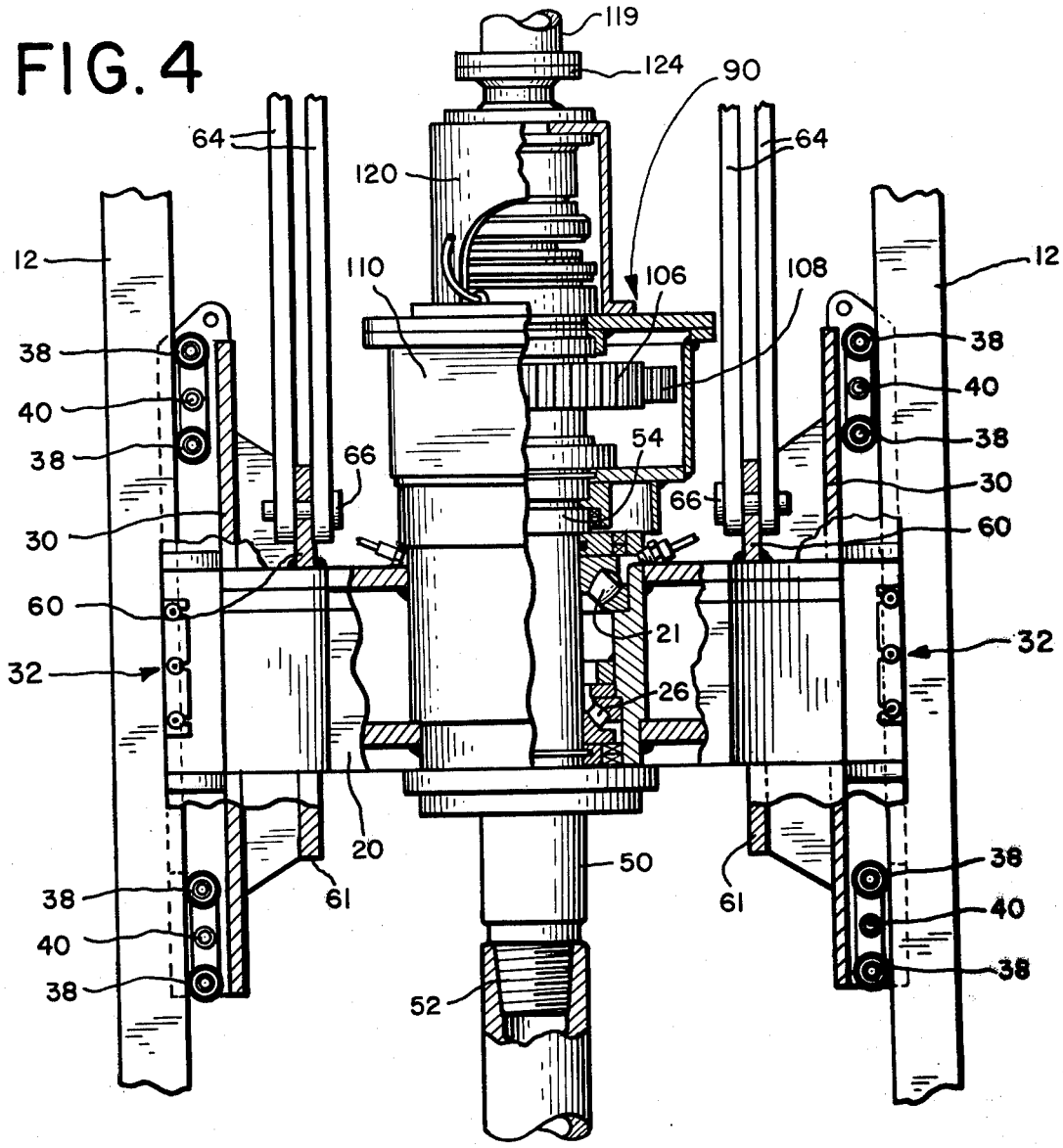
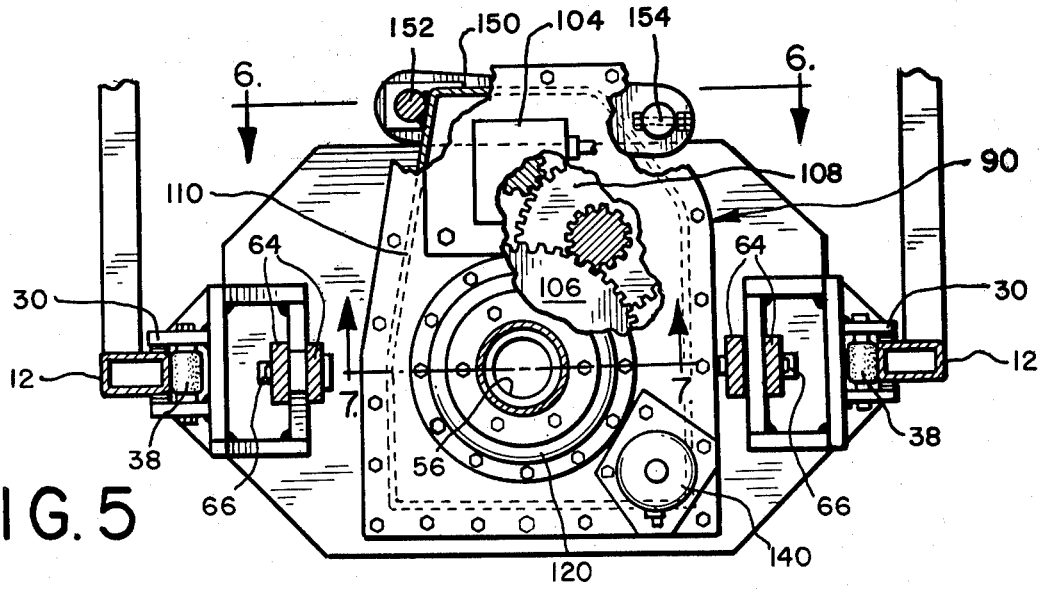
FIG. 5

APPARATUS FOR SUPPORTING AND ROTATING A DOWN HOLE TUBULAR

BACKGROUND OF THE INVENTION

This invention is related to an improved apparatus for supporting and rotating a down hole tubular in an earth boring apparatus.

One type of known earth boring apparatus includes a derrick which supports an apparatus which can be used to support and rotate down hole tubulars such as drill pipe. This apparatus, which is commonly known as either a top head drive or a swivel, is movable up and down along the length of the derrick. In addition, the swivel commonly includes a drilling fluid seal which conducts drilling fluid from a non-rotating conduit to a rotatable shaft included in the swivel, which shaft, in turn, can be connected to a string of drill pipe to pass drilling fluid from the non-rotating conduit to the drill pipe.

In that the swivel must support the entire weight of the drill string, it must be constructed to pass heavy downward loads to the derrick without excessive deformation. In addition, the swivel must apply large torques to rotate the drill string and conduct these torques to the derrick. The combination of large downward and large rotary stresses presents several problems which can result in damage to the swivel and the derrick if not properly overcome.

First, down hole tubulars such as drill pipe are often not perfectly straight. When rotated by the swivel, such crooked tubulars can exert large skew forces on the swivel as the axis of rotation of the tubular shifts slightly in each cycle of rotation. In the past, these skew forces have resulted in chipped or spalled bearings in the swivel.

Second, rotary drive units and drilling fluid seals generally require precise alignment with the swivel shaft if they are to operate reliably. Eccentricities between the swivel shaft and the drive unit can result in undesirable wear and breakage in the drive unit, and eccentricities between the swivel shaft and the drilling fluid seal can result in undesirable leakage of drilling fluid as it leaves the non-rotating conduit and enters the swivel shaft.

SUMMARY OF THE INVENTION

The general object of this invention is to provide an improved apparatus for supporting and rotating a down hole tubular, which apparatus provides high precision alignment between a shaft and a drive unit while accommodating the large skew forces which may be applied to the shaft during earth drilling operations.

According to this invention, an apparatus for an earth boring device including a derrick is provided with a support member which is guided along the derrick such that the support member is substantially prevented from twisting with respect to the derrick. First bearing means are provided for supporting a shaft adapted for connection to a drill string to the support member such that the shaft is rotatable with respect to the support member and the first bearing means accommodates a selected degree of skewness of the shaft with respect to the first bearing means. In addition, drive means for rotating the shaft are precisely aligned on the shaft adjacent the support means by second bearing means. The drive means is substantially prevented from rotating with respect to the support member such that the drive means is movable relative to the support member and is substantially free to follow the lateral movement of the shaft as it rotates in the first bearing means without subjecting the second bearing means to excessive skew forces.

One important advantage of this invention is that the drive means is mounted so as to be free to follow the movement of the shaft as it rotates in the load supporting bearings of the support member. This permits precise alignment between the bearings of the drive means and the shaft, and decreases wear on the drive means.

A second important advantage is that the bearings of the support member are chosen to accommodate a limited amount of skewness of the shaft without damage to the bearings. Thus, the present invention does not attempt to coerce the shaft into maintaining a fixed axis of rotation. Instead, the shaft is allowed to shift slightly to follow the skew forces applied during the rotation of crooked drill pipe.

The present invention provides an improved apparatus which allows the driven shaft to shift slightly during rotation as necessary to reduce skew forces on the bearings of the support member, while simultaneously allowing the driving means to move freely to follow the driven shaft. In this way precise alignment is obtained for the driving means without subjecting the bearings of either the support member or the driving means to excessive skew forces.

The invention, together with further objects and attendant advantages, will be best understood by reference to the following detailed description taken in connection with the accompanying drawings.

BRIEF DESCRIPTION OF THE DRAWINGS

FIG. 1 is a perspective view of a top head drive apparatus for an earth boring apparatus, incorporating a preferred embodiment of the present invention.

FIG. 2 is a partial perspective view of a side portion of the drive apparatus of FIG. 1.

FIG. 3 is a sectional view taken along line 3—3 of FIG. 2.

FIG. 4 is an elevational view in partial cutaway taken along line 4—4 of FIG. 1.

FIG. 5 is a top view in partial cutaway of the drive apparatus of FIG. 1.

Figure 6:
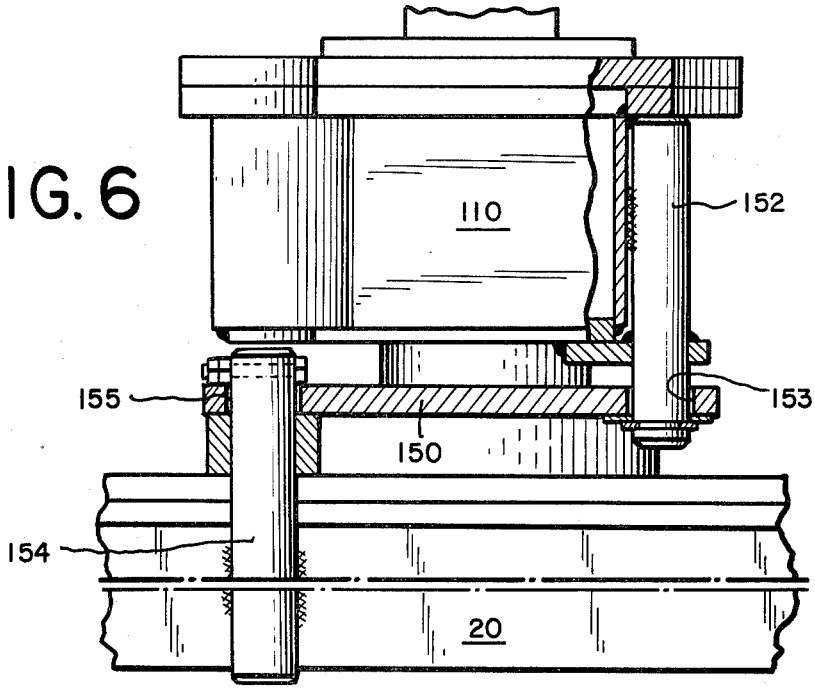
FIG. 6 is an elevational view taken along line 6—6 of FIG. 5.
Figure 7C:
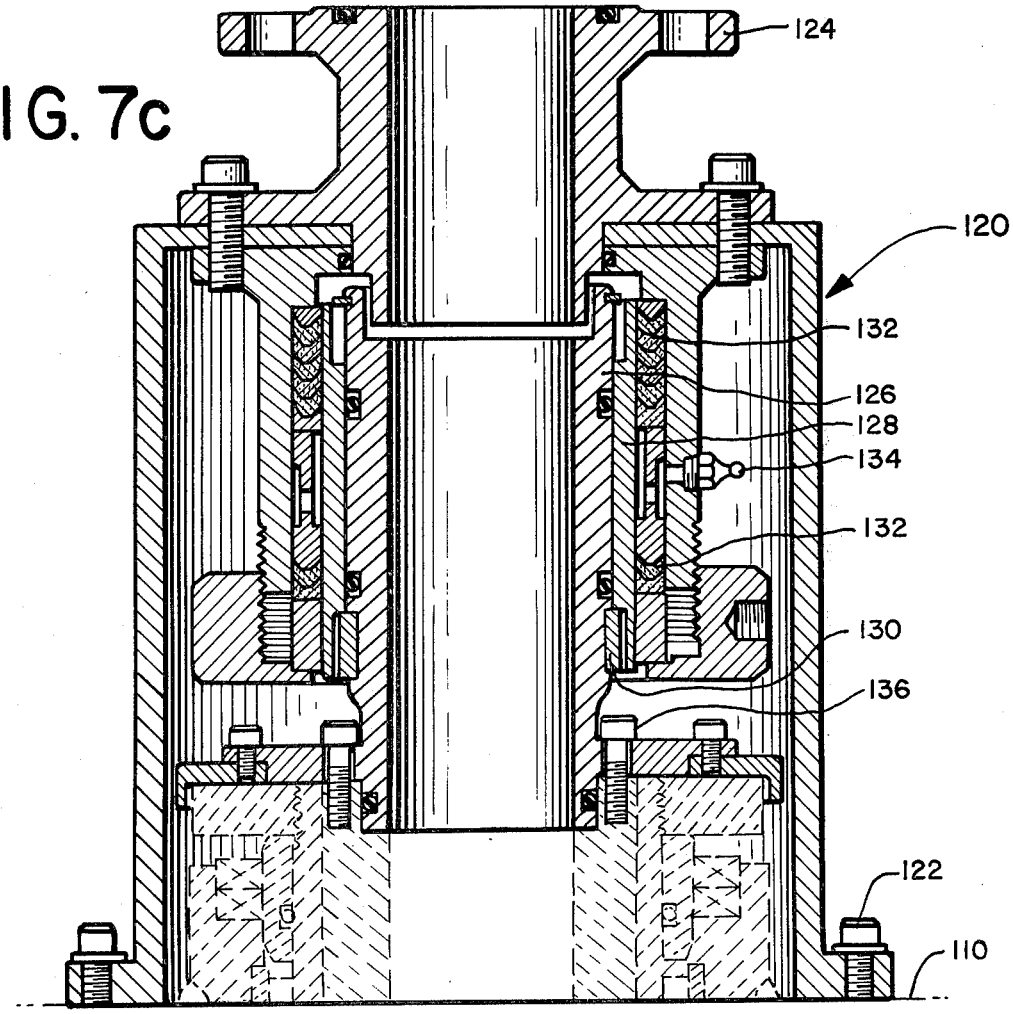
Figure 7A:
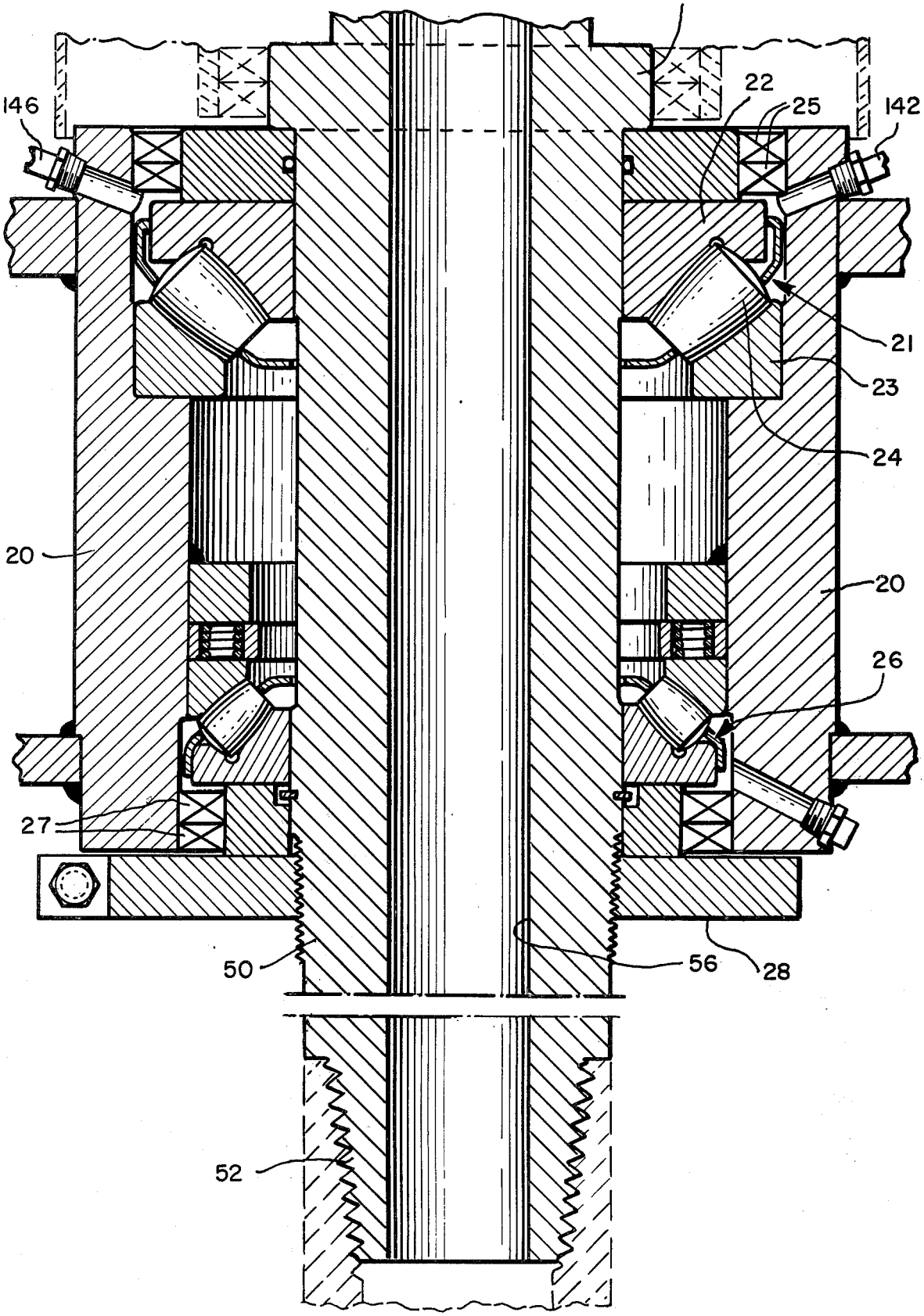
Figure 7B:
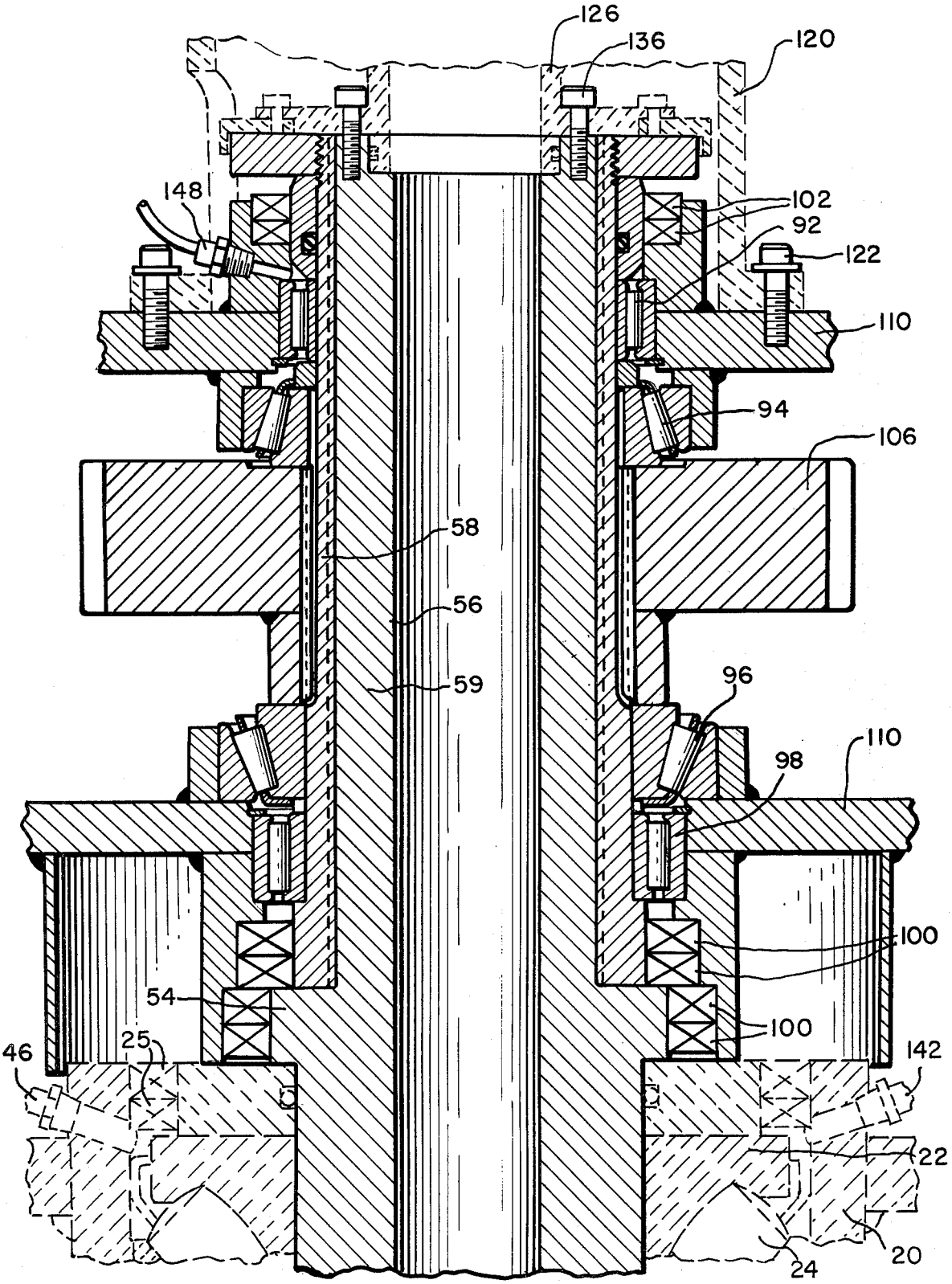

FIG. *7a* is a cross-sectional view of the lower portion of the apparatus of FIG. 1 taken along line 7—7 of FIG. 5.

FIG. *7b* is a cross-sectional view of the central portion of the apparatus of FIG. 1 taken along line 7—7 of FIG. 5.

FIG. *7c* is a cross-sectional view of the upper portion of the apparatus of FIG. 1 taken along line 7—7 of FIG. 5.

DETAILED DESCRIPTION OF A PREFERRED EMBODIMENT

Referring now to the drawings, FIGS. 1 and 4 are a general perspective and elevational views, respectively, of a top head drive apparatus 10 which incorporates a preferred embodiment of the present invention. This top head drive 10 is adapted for use with an earth boring apparatus which includes a vertical derrick which defines vertical guide rails 12. A portion of the derrick is shown in dashed lines in FIG. 1.

The top head drive 10 includes a support member 20 which is rigidly attached at each end to a guide bar 30. The guide bar 30 serves to align the top head drive 10 along the parallel guide rails 12 of the derrick. FIGS. 2 and 3 show perspective and cross-sectional views of a portion of the guide bar 30. As shown in FIGS. 2 and 3, the guide bar 30 includes opposed pairs of lateral guide structures 32. Each lateral guide structure 32 includes a lateral guide pad 34 which is urged against the derrick rail 12 by three positioning bolts 36. Preferably, the lateral guide pads 34 are formed of a lubricated plastic material such as nylatron. The opposed lateral guide structures 32 serve to prevent twisting or shifting of the guide bars 30 in the plane of FIG. 3. As best shown in FIG. 1 each guide bar 30 includes three sets of lateral guide structures 32 spaced along the length of the guide bar 30.

In addition, each guide bar 30 includes two sets of guide rollers 38. Each set of guide rollers 38 includes two guide rollers 38 trunnion mounted to a common pivot shaft 40 which is secured to the guide bar 30. Two sets of guide rollers 38 are mounted to each guide bar 30 at opposite ends thereof. In each case adjusting the screws 42 are provided to position the pivot shaft 40 of the trunnion mounted rollers 38 to control the spacing between the rollers 38 and the derrick rail 12. By properly positioning the adjustment screws 42, lateral shifting of the guide bars 30 in a direction parallel to the support member 20 can be maintained at the desired level. Preferably each of the guide rollers 38 is covered with a resilient tire of a plastic material such as polyurethane. The resilience of the guide rollers 38 serves to reduce shock transmitted from the guide bars 30 via the derrick rails 12 to the derrick.

Returning to FIGS. 1 and 4, the top head drive 10 includes a drive shaft 50 which passes through the support member 20. The lower end 52 of the drive shaft 50 is provided with threads adapted to connect the drive shaft 50 with one or more subs, and via the subs to one or more down hole tubulars such as a drill string, for example. During a drilling operation the entire weight of the drilling string will on occasion be supported by the drive shaft 50, which is in turn supported by the support member 20.

A pair of spaced plates 60 are rigidly mounted to the support member 20. Each of these plates 60 terminates in an upper pivot 66 at which point the plate 60 is pivotally connected to an arm 64 which includes at it upper end a sheave 62. In use, cables 63 are utilized in connection with the sheaves 62 to control the vertical position of the top head drive 10 in the derrick. Thus the support member 20 is supported by the plates 60, which are in turn supported by the arms 64 and the cables 63 which pass through the sheaves 62. Preferably each of the plates 60 is provided with a widened lower section 61 situated beneath the support member 20. The plate 60 and its lower section 61 are preferably securely welded to the support member 20 so as to carry the heavy downward loads reliably.

The top head drive 10 also includes a rotary drive unit 90 positioned around the shaft 50 above the support member 20. This rotary drive unit 90 includes a hydraulic motor 104 which powers a transmission contained within the transmission case 110. The transmission serves to apply rotary forces to the shaft 50 to rotate attached tubulars, such as a drill string, for example, during drilling operations.

As best shown in FIG. 6, torque generated by the hydraulic motor 104 is conducted to the derrick via a torque arm 150 which is mounted between the transmission case 110 and the support member 20. This torque is then transmitted to the derrick rails 12 by means in the lateral guide structures 32 included in the guide bars 30.

A drilling fluid seal 120 is rigidly mounted to the upper surface of the transmission case 110. This seal 120 serves to prevent drilling fluid from leaking out as it is passed from a non-rotating conduit 119 which is attached to the upper surface of the seal 120. This drilling fluid is passed into an internal passageway 56 defined by the drive shaft 50 and is conducted via this internal passageway 56 to the interior of the drill string.

FIGS. 5, 6, *7a*, *7b* and *7c* provide detailed drawings of the support member 20, the rotary drive unit 90, and the drilling fluid seal 120. The following discussion will refer to these drawings to provide a detailed description of the functioning and operation of these three major components of the top head drive 10.

FIG. *7a* shows a cross-sectional view of the central portion of the support member 20. As shown in FIG. *7a*, the drive shaft 50 includes a shoulder 54 positioned immediately above the upper edge of the support member 20. The support member 20 includes a spherical roller bearing 21 which is made up of an inner race 22 an outer race 23, and a plurality of spherical rollers 24. The outer race 23 is rigidly mounted to the support member 20, such that the outer race 23 will support large downward loads. The inner race 22 is mounted to the drive shaft 50 such that downward loads on the drive shaft 50 are transmitted via the shoulder 54 to the inner race 22. These downward loads are then passed via the rollers 24 and the outer race 23 to the support member 20. A pair of composite oil seals 25 are situated in the support member 20 above the spherical roller bearing 21 in order to prevent the leakage of lubricants out of the interior of the support member 20. A lower spherical roller bearing 26 is provided to transmit upward loads on the shaft 50 to the support member 20. Oil seals 27 are provided below the lower bearing 26 to prevent the leakage of lubricant out of the interior of the support member 20. The compression nut 28 serves to preload the bearings 21,26.

Preferably both bearings 21,26 are spherical roller bearings. In this preferred embodiment the upper spherical roller bearing 21 is Part No. 29434, marketed by the SKF Corporation. The basic load rating on this bearing is 325,000 pounds. In this preferred embodiment the lower spherical roller bearing is Part No. 29334, marketed by the SKF Corporation, which has a basic load rating of 173,000 pounds. Spherical roller bearings are preferably used in the support member 20 because they allow a slight amount of skewness between the inner and outer races of the bearings without chipping or spalling either the rollers themseleves or the races. Thus the bearings 21,26 are chosen to allow the drive shaft 50 to shift slightly in the bearings 21,26 without damaging them. This means that the axis of rotation of the drive shaft 50 is not precisely controlled by the bearings 21,26; on the contrary, a predetermined amount of skewness of the drive shaft 50 can be tolerated by the bearings 21,26 without damaging the bearings.

The bearings 21,26 of the support member 20 serve to support the axial loads on the drive shaft 50 while allowing the axis of rotation of the drive shaft 50 to move. As discussed above, this is desirable because crooked down hole tubulars, when rotated, will apply skew forces to the drive shaft 50. If the bearings 21,26 are not adapted to accommodate a limited amount of skewness of the shaft 50, bearing damage can result.

FIGS. 5 and *7b* show cutaway and cross-sectional views of the rotary drive unit 90, including the hydraulic motor 104 and the transmission case 110. As shown in FIG. *7b* the drive shaft 50 extends up through the transmission case 110. Upper and lower roller bearings 92,98 are positioned between the shaft 50 and the transmission case 110 in order to center the shaft 50 precisely within the case 110. In addition, tapered roller bearings 94,96 are mounted between the shaft 50 and the transmission case 110. Oil seals 100,102 are placed at the lower and upper surfaces of the transmission case 110 respectively, in order to seal the interior of the transmission case 110 around the shaft 50. A drive gear 106 is provided with splines which mount the gear 106 to the shaft 50. This drive gear 106 is driven by an intermediate gear 108 which is in turn driven by the hydraulic motor 104. The hydraulic motor 104 applies rotary power via the intermediate gear 108 and the drive gear 106 to rotate the shaft 50, and with it whatever down hole-tubulars are attached to the shaft 50.

In this preferred embodiment, the tapered roller bearing 94 is preferably Bearing No. 46720/46780 of the Timken Corporation, the tapered roller bearing 96 is preferably Bearing No. 67720/67780 of the Timken Corporation, the roller bearing 92 is preferably a needle bearing No. NA4830 of INA Corporation and the roller bearing 98 is preferably a needle bearing No. Na4834 of INA Corporation.

As shown in FIG. 6, an upper bar 152 is rigidly secured to a vertical face of the transmission case 110. This upper bar 152 fits within an aperture 153 formed in the torque arm 150. This torque arm 150 extends substantially horizontally at approximately the level of the upper edge of the support member 20. Attached to an aperture 155 in the other end of the torque arm 150 is a lower bar 154 which is in turn rigidly secured, as by welding for example, to the support member 20. The torque arm 150 substantially prevents the transmission case 110 from rotating with respect to the support member 20 in a plane perpendicular to the shaft 50. Thus the torque arm 150 serves to provide a reaction point for the hydraulic motor 140 as it applies torque to rotate the shaft 50. The appertures 153,155 and the connections between the torque arm 150 and the upper and lower arms 152,154 are loose so as to allow the upper and lower arms 152, 154 to assume slightly skew positions with respect to each other.

A lubricnt reservoir 140 is mounted to the top of the transmission case 110. This reservoir 140 is connected by an oil passage (not shown) in the transmission case 110 to the interior of the transmission case 110 and by an oil line 142 to the interior of the support member 20. In addition, breather lines 146,148 are provided to conduct overflow fluids from the interior of the support member 20 and the transmission case 110, respectively, back to the reservoir 140. The reservoir 140 is preferably filled with a suitable lubricant such as gear oil, which is then supplied under gravity pressure to both the support member 20 and the transmission case 110. In this way, lubricant is supplied in adequate volume to each of the bearings and gears of the rotary drive unit 90 and the suport member 20. Preferably the oil line 142 and the breather lines 146,148 are made of a translucent material in order that the level of lubricant in the reservoir 140 can be visually checked.

The shaft 50 is made up of two separate pieces: an inner member 59 which defines the shoulder 54 and forms the core of the shaft 50, and an outer sleeve 58. The outer sleeve 58 is preferably connected to the inner member 59 by means of mating splines formed in the inner surface of the sleeve 58 and the outer surface of the inner member 59. In addition, the outer sleeve 58 defines splines to receive and hold the drive gear 106. An important advantage of this two-part construction for the shaft 50 is that, when necessary, the transmission case 110 can be easily and simply removed from the shaft 50 without disturbing the bearings 92,94,96,98 or the seals 100,102.

The entire rotary drive unit 90 can be simply removed from the shaft 50 by merely removing the fasteners 122,136 and then sliding the transmission case 110 and the outer sleeve 58 from the inner member 59. Thus, the interior of the transmission case 110 is not disturbed, and the outer sleeve 58 remains as a barrier to contamination of the interior of the transmission case 110. This feature of the invention provides the important advantage that the entire rotary drive unit 90 can be removed and replaced simply and easily in the field. This reduces the length of time which the flow of drilling fluids must be interrupted, and therefore the danger of cave-in or stuck drill strings in the event of a failure in the rotary drive unit 90.

As previously mentioned, the bearings 92,94,96,98 serve to align the transmission case 110 precisely with respect to the shaft 50. Because the fit between the upper bar 152 and the torque arm 150, and the fit between the lower bar 154 and the torque arm 150, is relatively loose, the transmission case 110 is free to move with respect to the support member 20 as it follows the lateral movement of the shaft 50 as it rotates. In this preferred embodiment, the shaft 50 and the torque arm 150 provide the only load bearing connections between the rotary drive unit 90 and the support member 20. Thus, the rotary drive unit 90 is free to follow the lateral movement of the shaft 50 without applying excessive skew forces to any of the roller bearings 92,94,96,98.

FIG. *7c* provides a cross-sectional view of the drilling fluid seal 120. This seal is rigidly mounted to the upper surface of the transmission case 110 of the rotary drive unit 90 by bolts 122, which serve to transmit torque from the drilling fluid seal 120 to the rotary drive unit 90. This seal 120 includes an upper flange 124 which is sized to mate with the non-rotating conduit 119 through which drilling fluid is introduced into the drilling fluid seal 120. A hollow stem 126 is rigidly mounted to the upper end of the shaft 50 by means of bolts 136. The stem 126 rotates with the shaft 50 as the shaft 50 is driven by the rotary drive unit 90. The stem 126 is surrounded in part by a cylindrical wear sleeve 128 which is held in place by a key 130 so as to rotate concentrically with the stem 126. This wear sleeve 128 is preferably made of a hardened steel adapted to resist abrasion against the V-packing 132 of the seal. This V-packing 132 is lubricated by pressurized grease introduced between the two sets of V-packing 132 via the grease nipple 134.

In that the entire drilling fluid seal 120 is rigidly mounted to the transmission case 110, the seal 120 is precisely aligned with the stem 126 by means of the rotary drive unit bearings 92,94,96,98. This precise alignment is important if a good seal is to be obtained to substantially prevent the leakage of drilling fluid through the seal 120. Because the wear sleeve 28 is formed as a separate member held in place on the stem 126 by the key 130, the wear sleeve 128 can be easily removed and replaced when it becomes excessively eroded in use. This prevents the need for replacing the entire stem 126.

From the foregoing, it should be apparent that an improved top head drive has been described which utilizes a rotary drive unit 90 which is movable relative to a support member 20 as necessary to follow the movement of the shaft 50 as it rotates in the bearings 21,26 of the support member 20. By separating the means for mounting the rotary drive unit 90 from the means for supporting the weight of the shaft 50, important advantages are obtained. First, spherical roller bearings or the like can be used to support the weight of the shaft 50 in order to prevent these bearings from becoming chipped or spalled due to skew forces applied by the shaft 50 as it rotates. Furthermore, precise alignment ca be obtained between the shaft 50 and the transmission case 110, a feature which is important in reducing wear and leakage of the transmission and the transmission case 110. In addition, the drilling fluid seal 120 is also precisely aligned with the shaft 50 in order to prvide an effective and reliable seal preventing the leakage of drilling fluid.

Of couse it will be apparent to those skilled in the art that various changes and modifications can be made to the preferred embodiment described above. For example, instead of rigidly mounting the drilling fluid seal 120 the transmission 110, the drilling fluid seal 120 can be provided with bearing means for independently positioning the drilling fluid seal 120 about the shaft 50, and separate means can be provided for preventing the drilling fluid seal 120 from rotating with respect to the support member 20. In addition, the top head drive shown can be scaled as necessary for either higher or lower load applications. Such changes and modifications can be made without departing from the spirit and scope of the present invention. It is therefore intended that the following claims be interpreted to cover all such changes and modifications.

I claim:

1. A drive apparatus for an earth boring apparatus including a derrick, said drive apparatus comprising:

a support member;

means for guiding the support member along the derrick such that the support member is substantially prevented from twisting with respect to the derrick;

a shaft adapted for connection to a drill string to support the weight of the drill string;

first bearing means for supporting the shaft on the support member such that the shaft is rotatable with respect to the support member and the first bearing means accommodates a selected degree of skewness of the shaft with respect to the support member;

rotary drive means for rotating the shaft;

second bearing means for precisely aligning the rotary drive means on the shaft adjacent the support member; and holding means for substantially preventing the rotary drive means from rotating with respect to the support member in a plane perpendicular to the longitudinal axis of the shaft;

said rotary drive means coupled to the holding means and the shaft such that the rotary drive means is movable relative to the support member and the rotary drive means is substantially free to follow lateral movement of the shaft as it turns in the first bearing means without subjecting the second bearing means to excessive skew forces.

2. The invention of claim 1 further comprising:

a lubricant reservoir mounted to move with the support member in the derrick such that at least a portion of the lubricant reservoir is situated above the first and second bearing means; and means for conducting lubricant from the lubricant reservoir down to the first and second bearing means.

3. The invention of claim 1 wherein the shaft is hollow and the invention further comprises:

a drilling fluid seal;

means for mounting the drilling fluid seal adjacent the upper end of the shaft; and means for transferring torque from the drilling fluid seal to the support member such that the drilling fluid seal is free to follow the lateral movement of the shaft as it turns in the first bearing means, yet the drilling fluid seal is substantially prevented from rotating with respect to the support member.

4. The invention of claim 3 wherein the means for transferring torque from the drilling fluid seal to the support member includes means for rigidly fastening the drilling fluid seal to the rotary drive means.

5. The invention of claim 1 wherein the shaft comprises:

an outer sleeve drivingly engaged with the rotary drive means;

an inner member positioned within the outer sleeve; and means for engaging the outer sleeve and the inner member such that drive forces developed by the rotary drive means are transmitted to the inner member, yet the rotary drive means is readily removable from the inner member by sliding the rotary drive means and the outer sleeve off of the inner member.

6. The invention of claim 5 wherein the means for engaging the outer sleeve and the inner member comprises mating splines formed in the outer sleeve and the inner member.

7. The invention of claim 1 wherein the holding means includes a torque arm mounted between the rotary drive means and the support member substantially to prevent rotation of the rotary drive means with respect to the support member, and the torque arm and the shaft provide the only load bearing interconnections between the rotary drive means and the support member.

8. The invention of claim 1 wherein the first bearing means comprises at least one spherical roller bearing and the second bearing means comprises at least one straight sided roller bearing.

9. The invention of claim 8 wherein the at least one straight sided roller bearing includes a plurality of tapered rollers.

10. A drive apparatus for an earth boring apparatus including a derrick which defines a pair of spaced rails, said drive apparatus comprising:

a support member;

means for guiding the support member along the rails of the derrick such that the support member is movable along the derrick;

a shaft adapted for connection to a drill string to support the weight of the drill string;

a first bearing mounted between the support member and the shaft such that vertical loads on the shaft are transmitted via the first bearing to the support member, said first bearing adapted to accommodate a selected degree of variations in the axis of rotation of the shaft associated with rotation of assymetrical down hole tubulars without damaging the first bearing;

rotary drive means for rotating the shaft;

a second bearing mounted between the shaft and the rotary drive means to align the rotary drive means precisely on the shaft adjacent the support member such that the rotary drive means follows the lateral movement of the shaft as it turns in the first bearing; and a torque arm mounted between the rotary drive means and the support member such that the rotary drive means is substantially prevented from rotating about the support member in a plane perpendicular to the longitudinal axis of the shaft but the rotary drive means is free to follow lateral movement of the shaft as it turns in the first bearing without subjecting the second bearing to excessive skew forces.

11. The invention of claim 10 further comprising:

a lubricant reservoir mounted to move with the support member in the derrick such that at least a portion of the lubricant reservoir situated above the first and second bearings; and means for conducting lubricant from the lubricant reservoir down to the first and second bearings.

12. The invention of claim 10 wherein the shaft is hollow and the invention further comprises:

a drilling fluid seal;

means for mounting the drilling fluid seal adjacent the upper end of the shaft; and means for transferring torque from the drilling fluid seal to the support member such that the drilling fluid seal is free to follow lateral movement of the shaft as it turns in the first bearing, yet the drilling fluid seal is substantially prevented from rotating with respect to the support member.

13. The invention of claim 12 wherein the means for transferring torque from the drilling fluid seal to the support member comprises means for rigidly fastening the drilling fluid seal to the rotary drive means.

14. The invention of claim 10 wherein the shaft comprises:

an outer sleeve drivingly engaged with the rotary drive means;

an inner member positioned within the outer sleeve; and means for engaging the outer sleeve and the inner member such that drive forces developed by the rotary drive means are transmitted to the inner member, yet the rotary drive means is readily removable from the inner member by sliding the rotary drive means and the outer sleeve off of the inner member.

15. The invention of claim 14 wherein the means for engaging the outer sleeve and the inner member comprises mating splines formed in the outer sleeve and the inner member.

16. The invention of claim 10 wherein the first bearing comprises a spherical roller bearing and the second bearing comprises a straight sided roller bearing.

17. The invention of claim 16 wherein the straight sided roller bearing includes a plurality of tapered rollers.

18. A drive apparatus for an earth boring drilling apparatus including a derrick which defines a pair of spaced rails, said drive apparatus comprising:

a support member having an opening passing therethrough;

means for guiding the support member along the rails of the derrick such that the support member is movable along the length of the derrick;

a first bearing mounted within the support member adjacent the opening therein;

a shaft adapted for connection to a drill string to support the weight of the drill string, said shaft mounted in the first bearing such that vertical loads on the shaft are transmitted via the first bearing to the support member;

a rotary drive unit including a drive motor drivingly engaged to a transmission which is enclosed in a transmission case having an opening passing therethrough, said rotary drive unit positioned on the shaft adjacent the support member such that the shaft passes through the opening in the transmission case;

a second bearing mounted to the shaft within the transmission case to cause the rotary drive unit to maintain precise alignment with the shaft as the shaft rotates in the first bearing;

a torque arm mounted between the rotary drive unit and the support member to prevent rotation of the rotary drive unit with respect to the support member in a plane perpendicular to the longitudinal axis of the shaft;

said first bearing adapted to accommodate shifts in the axis of rotation of the shaft associated with the rotation of assymetrical down hole tubulars without damaging the first bearing;

said torque arm mounted to the rotary drive unit and the support member to permit the rotary drive unit to follow lateral movement of the shaft as it rotates in the first bearing without applying excessive skew forces to the second bearing.

19. The invention of claim 18 further comprising:

a plurality of seals mounted between the shaft and the transmission case adjacent the opening therein to seal the interior of the transmission case;

a plurality of seals mounted between the shaft and the support member adjacent the opening therein to seal the interior of the support member;

a lubricant reservoir mounted to move with the support member;

a conduit extending between the reservoir and the interior of the support member to conduct lubricant from the reservoir to the support member to maintain the support member substantially filled with lubricant; and a conduit extending between the reservoir and the interior of the transmission case to conduct lubricant from the reservoir to the transmission case to maintain the transmission case substantially filled with lubricant.

20. The invention of claim 18 further comprising:

a drilling fluid seal rigidly mounted to the rotary drive unit around the upper end of the shaft.

21. The invention of claim 18 wherein the shaft comprises:

an outer sleeve extending through the transmission and drivingly engaged with the transmission, said outer sleeve defining a plurality of internal splines; and an inner member extending through the transmission case and the support member, said inner member provided with a plurality of mating splines to drivingly engage the internal splines of the sleeve;

said internal and mating splines cooperating to releasably secure the sleeve to the inner member such that the rotary drive unit can be removed by sliding the transmission case off the inner member while maintaining the sleeve in place in the transmission case.

22. The invention of claim 18 wherein the first bearing is a spherical roller bearing and the second bearing is a straight sided roller bearing.

23. The invention of claim 22 wherein the staight sided roller bearing includes a plurality of tapered rollers.

* * * * *